United States Patent [19]

Fricker

[11] Patent Number: 4,811,700

[45] Date of Patent: Mar. 14, 1989

[54] SOUND INSULATED VEHICLE DRIVE UNIT

[75] Inventor: Ludwig Fricker, Stuttgart, Fed. Rep. of Germany

[73] Assignee: Daimler-Benz Aktiengesellschaft, Fed. Rep. of Germany

[21] Appl. No.: 105,287

[22] Filed: Oct. 7, 1987

[30] Foreign Application Priority Data

Oct. 9, 1986 [DE] Fed. Rep. of Germany ..... 3634454

[51] Int. Cl.[4] ..... F02B 77/00

[52] U.S. Cl. ..... 123/198 E; 123/195 C

[58] Field of Search ..... 123/198 E, 195 C, 195 S, 123/41.7; 181/204, 227, 228, 240; 180/69.1

[56] References Cited

U.S. PATENT DOCUMENTS

| | | | |
|---|---|---|---|
| 4,071,008 | 1/1978 | Skatsche et al. | 123/198 E |
| 4,203,407 | 5/1980 | Fachbach et al. | 123/198 E |
| 4,203,409 | 5/1980 | Fachbach et al. | 123/198 E |
| 4,241,202 | 12/1980 | Takeuchi et al. | 123/198 E |
| 4,267,805 | 5/1981 | Schmuck | 123/198 E |
| 4,287,861 | 9/1981 | Lattner et al. | 123/198 E |
| 4,343,271 | 8/1982 | Skatsche et al. | 123/198 E |
| 4,455,971 | 6/1984 | Kirchweger et al. | 123/198 E |
| 4,459,944 | 7/1984 | Kirchweger et al. | 123/198 E |

*Primary Examiner*—Raymond A. Nelli

*Attorney, Agent, or Firm*—Barnes & Thornburg

[57] ABSTRACT

A drive unit comprising a reciprocating-piston type internal combustion engine and a transmission and output shaft is disclosed in which the sound-generating parts of the internal combustion engine are combined to form one driving mechanism body which is supported via an element which transmits power and isolates structure-borne sound, at the engine casing constructed as a noise capsule. To prevent sound from being radiated from the transmission casing towards the outside and structure-borne sound from being transmitted to the noise capsule, the transmission casing is rigidly connected to the driving mechanism carrier and the noise capsule also encloses the entire transmission casing.

15 Claims, 1 Drawing Sheet

SOUND INSULATED VEHICLE DRIVE UNIT

BACKGROUND AND SUMMARY OF THE INVENTION

The invention relates to a vehicle drive unit of the type having a reciprocating piston engine, a transmission, and a transmission output shaft. The engine sound generating parts are enclosed in an engine casing. Such a drive unit is known from German published unexamined patent application (DOS) No. 2,612,182. Although the entire driving mechanism carrier is suspended in a structure-borne noise isolated manner in the noise capsule in this known drive unit, the disadvantage is that the transmission casing is rigidly connected to the noise capsule so that the transmission noises and the noises originating from the output shaft outside the transmission are transmitted to the noise capsule which can thus only incompletely fulfill its task of sound insulation. In addition, the sound insulation of the driving mechanism carrier requires the crankshaft and transmission input shaft to be separated in the known drive unit, which separation is achieved by an elastic coupling inserted between them. However, this requires considerable installation space especially in a location in which in most cases, such as, for example, in a motor vehicle, there are very restrictive space conditions.

An object of the invention is to construct the known drive unit in such a manner that transmission of structure-borne noise to the noise capsule is presented even with a continuous metallic connection between the crankshaft and the transmission shaft.

In a drive unit of the type initially mentioned, this object is achieved by providing that the sound insulating engine casing also encloses the transmission and transmission casing.

Since any metallic connection between the transmission casing and the noise capsule is avoided in the drive unit constructed in accordance with the invention, the transmission of sound between these two and the radiation of sound from the transmission casing to the outside is avoided overall without requiring a flexible coupling between the crankshaft and the transmission shaft or an encapsulation which is remote from the engine.

Constructing the drive unit, in especially preferred embodiments, with the transmission output shaft connected via a flexible shaft coupling to a further output shaft, suppresses the transmission of sound generated in the internal combustion engine or the transmission via the output shaft to the outside, the flexible coupling being arranged at a location which provides sufficient space.

The construction of the drive unit in certain preferred embodiments with an elastic support assembly connecting the crankshaft and transmission output shaft at the engine casing noise capsule, offers the advantage of supporting the output shaft in the noise capsule which completely closes the latter off towards the outside but, at the same time, allows relative movements between the output shaft and the noise capsule. In especially preferred embodiments with a toothed elastic ring coupling, a better compound effect between the support rings and the elastic ring layer which provides the possibility of increased carrying capability of the support is obtained.

Due to the construction of especially preferred embodiments of the drive unit, with a skeleton type transmission and the transmission casing constructed as a support frame, resultant increases in weight can be avoided by reducing the dimensions of the transmission casing to form a support frame carrying the transmission shafts since the tasks of the transmission casing as outside shielding and oil container can be taken over by the noise capsule in the drive unit according to the invention.

Other objects, advantages and novel features of the present invention will become apparent from the following detailed description of the invention when considered in conjunction with the accompanying drawings.

DETAILED DESCRIPTION OF THE DRAWINGS

Figure 1:
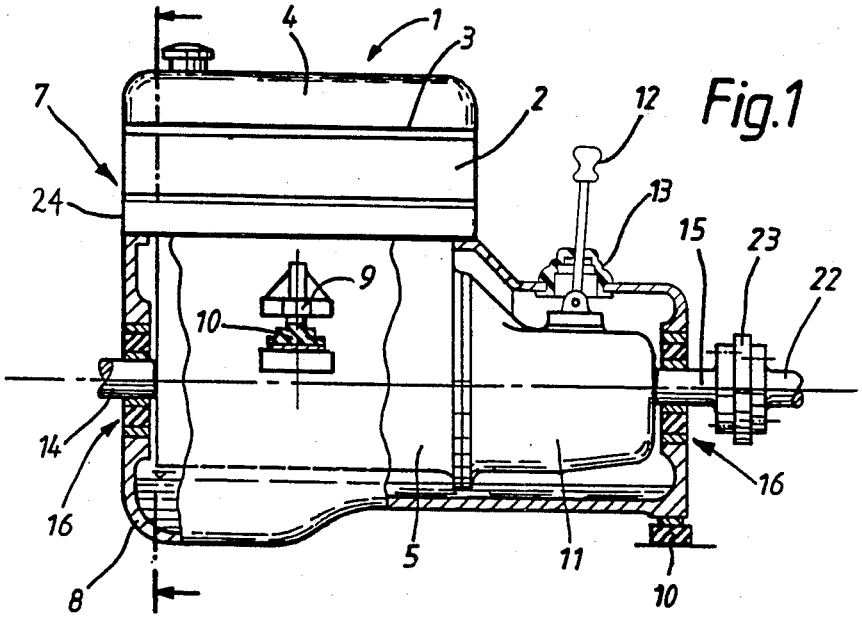
FIG. 1 is a schematic longitudinal part-sectional view of a drive unit consisting of internal combustion engine, transmission and output shaft, constructed in accordance with a preferred embodiment of the invention.
Figure 2:
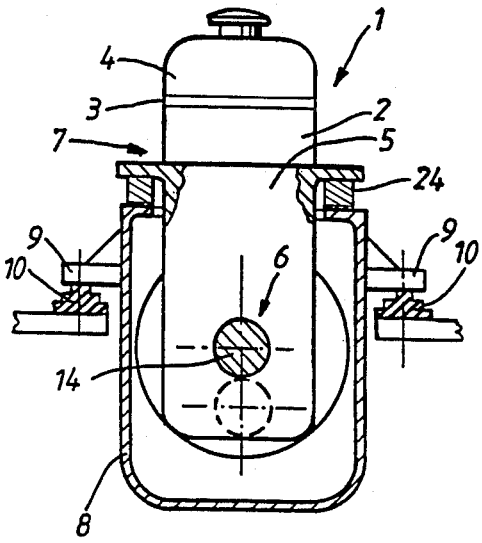
FIG. 2 is a schematic sectional view of the FIG. 1 drive unit.
Figure 3:
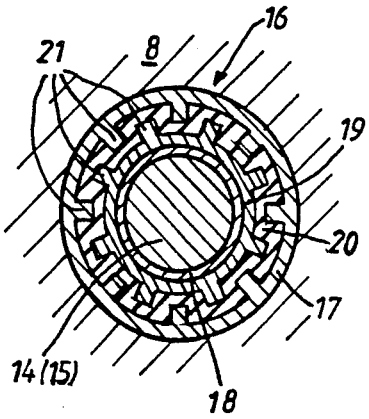
FIG. 3 is an enlarged sectional front view of a support of the output shaft in the noise capsule of FIGS. 1 and 2.

In the reciprocating-piston-type internal combustion engine 1 constructed as a skeleton engine, the driving mechanism carrier 7, essentially consisting of cylinder head 1, on which a cylinder head cover 4 separated by a noise-damping gasket 3 is placed, cylinder housing 5 and crank mechanism 6, is placed on the engine casing 8 with interposition of a frame-shaped elastic sealing strip 24.

The engine casing 8, which at the same time is used as oil sump for the internal combustion engine 1, extends into the upper area of cylinder casing 5 and completely surrounds the lower area of crank mechanism 6 so that it serves, together with the elastic non-metallic connection to the driving mechanism carrier 7, as a noise capsule which damps all noises emanating from the latter. The engine casing 8 is suspended via engine carriers 9 and elastic engine bearings 10.

On driving mechanism carrier 7, a transmission casing 11 comprising a manual or an automatic gear shift mechanism is mounted, if desired with interposition of a coupling housing. As can be seen from FIG. 1, the engine casing 8 is laterally extended so that it also completely encloses the transmission casing 11 and serves as a noise capsule and as oil sump for the transmission, which transmission is constructed in a skeleton type of construction.

The elements penetrating through the noise capsule such as a gear lever 12 are separated from the latter by elastic elements 13 so that the transmission of structure-borne noises from them from driving mechanism carrier 7 and transmission casing 11 to the noise capsule is prevented. The same applies to the penetration of crankshaft 14 and the transmission output shaft 15 as parts of the ouput shaft through the noise capsule in which they are supported with the aid of elastic support ring units 16. These ring units include an outer support ring 17 which is inserted into the noise capsule and an inner support ring 19 which is placed onto the crankshaft 14 and the transmission output shaft 15, respectively, with interposition of bearing shells 18, between which support rings an elastic ring layer 20 is located.

The two support rings 17 and 19 are provided with projections 21 which point towards one another and which engage the ring layer 20 offset with respect to one another over the circumference. This achieves a greater connecting surface and thus a better interconnection between the ring layer 20 and the two support rings 17 and 19, whereas the elasticity of the ring layer 20 is scarcely impaired both in the radial and in the circumferential direction.

Between transmission output shaft 15 and the adjoining part of the output shaft 22, an elastic flexible shaft coupling 23 is inserted outside the noise capsule which eliminates a transmission of sound out of the noise capsule via output shaft 22.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. An arrangement for housing and supporting a vehicle drive unit of the type including a reciprocating piston-type internal combustion engine drivingly connected via its crankshaft to a transmission enclosed in a transmission casing connected directly at a cylinder housing of the engine, said arrangement comprising:

a noise insulating engine and transmission casing which encloses the engine from below the cylinder housing and extends upwardly to a level above the crankshaft, said engine and transmission casing also enclosing the entire transmission casing at a spacing therefrom to thereby form a unitary noise insulating capsule around sound generating parts of both the engine and the transmission casing while also forming an oil-sump for the transmission.

2. An arrangement according to claim 1, wherein flexible shaft coupling means are provided at a location outside the noise insulating capsule for drivingly connecting a transmission output shaft to a further output shaft.

3. An arrangement, for housing and supporting a vehicle drive unit of the type including a reciprocating piston-type internal combustion engine drivingly connected via its crankshaft to a transmission enclosed in a transmission casing, said arrangement comprising:

a noise insulating engine and transmission casing which encloses the engine from below and extends upwardly to a level above the crankshaft, said engine casing also enclosing the entire transmission casing at a spacing therefrom to thereby form a noise insulating capsule around sound generating parts of the engine and around the transmission casing, wherein the noise insulating capsule includes a transmission output shaft opening for accommodating an output shaft of the transmission, and wherein an elastic support ring unit is inserted into said transmission output shaft opening for supporting the transmission output shaft.

4. An arrangement according to claim 3, wherein said elastic ring unit includes a radially outer support ring attached to the casing, a radially inner support ring attached to the transmission output shaft, and an elastic ring layer disposed between said support rings.

5. An arrangement according to claim 4, wherein the support rings are constructed as toothed rings which project into the elastic ring layer with projections offset with respect to one another over their circumference.

6. An arrangement according to claim 5, wherein flexible shaft coupling means are provided at a location outside the noise insulating capsule for drivingly connecting a transmission output shaft to a further output shaft.

7. An arrangement according to claim 4, wherein the noise insulating capsule includes an engine crankshaft opening for accommodating an engine crankshaft, and wherein an elastic support ring unit is inserted into said engine crankshaft opening for supporting the crankshaft, said engine crankshaft opening being disposed at a wall of said casing opposite the location of the wall of the transmission output shaft opening.

8. An arrangement according to claim 7, wherein said elastic ring unit for the crankshaft opening includes a radially outer support ring attached to the casing, a radially inner support ring attached to the crankshaft output shaft, and an elastic ring layer disposed between said support rings.

9. An arrangement according to claim 8, wherein the support rings for the crankshaft opening are constructed as toothed rings which project into the elastic ring layer with projections offset with respect to one another over their circumference.

10. An arrangement for housing and supporting a vehicle drive unit of the type including a reciprocating piston-type internal combustion engine drivingly connected via its crankshaft to a transmission enclosed in a transmission casing, said arrangement comprising:

a noise insulating engine and transmission casing which encloses the engine from below and extends upwardly to a level above the carnkshaft, said engine casing also enclosing the entire transmission casing at a spacing therefrom to thereby form a noise insulating capsule around sound generating parts of the engine and around the transmission casing, and elastic support means for elastically supporting the noise capsule at fixed vehicle parts.

11. An arrangement according to claim 10, wherein said elastic support means include elastic support blocks engageable with laterally protruding brackets of the engine casing at a location above the crankshaft.

12. An arrangement for housing and supporting a vehicle drive unit of the type including a reciprocating piston-type internal combustion engine drivingly connected via its crankshaft to a transmission enclosed in a transmission casing, said arrangement comprising:

a noise insulating engine and transmission casing which encloses the engine from below and extends upwardly to a level above the crankshaft, said engine casing also enclosing the entire transmission casing at a spacing therefrom to thereby form a noise insulating capsule around sound generating parts of the engine and around the transmission casing, wherein noise insulating capsule includes an engine crankshaft opening for accommodating an engine crankshaft, and wherein an elastic support ring unit is inserted into said engine crankshaft opening for supporting the crankshaft.

13. An arrangement according to claim 12, wherein said elastic ring unit includes a radially outer support ring attached to the casing, a radially inner support ring attached to the crankshaft output shaft, and an elastic ring layer disposed between said support rings.

14. An arrangement according to claim 13, wherein the support rings are constructed as toothed rings which project into the elastic ring layer with projections offset with respect to one another over their circumference.

15. An arrangement according to claim 12, further comprising elastic support means for elastically supporting the noise capsule at fixed vehicle parts.

* * * * *